United States Patent [19]

Ishihara et al.

[11] 4,298,815

[45] Nov. 3, 1981

[54] CATHODE RAY TUBE SOCKET WITH CONTROLLED SPARK GAPS

[75] Inventors: Theodore M. Ishihara, Chicago; John F. Kulkens, Park Ridge, both of Ill.

[73] Assignee: Zenith Radio Corporation, Glenview, Ill.

[21] Appl. No.: 92,862

[22] Filed: Nov. 9, 1979

[51] Int. Cl.[3] ..... H01J 17/00; H01J 21/00

[52] U.S. Cl. ..... 313/325; 313/318; 361/129; 361/130

[58] Field of Search ..... 313/325, 318; 361/129, 361/130, 118

[56] References Cited

U.S. PATENT DOCUMENTS

| | | | |
|---|---|---|---|
| 3,636,412 | 1/1972 | Simovits et al. | 361/129 |
| 3,716,819 | 2/1973 | Borth | 339/143 T |
| 3,748,521 | 7/1973 | Wright et al. | 313/325 |
| 3,805,108 | 4/1974 | Suzuki | 313/318 |
| 3,869,633 | 3/1975 | Dumas et al. | 313/325 |
| 3,916,238 | 10/1975 | Suzuki | 361/129 |
| 4,056,753 | 11/1977 | Keikichi et al. | 313/325 |
| 4,119,878 | 10/1978 | Uda | 361/129 |

*Primary Examiner*—Saxfield Chatmon, Jr.
*Attorney, Agent, or Firm*—Thomas E. Hill

[57] ABSTRACT

A cathode ray tube socket assembly incorporating controlled, or tuned, spark gaps coupling the high voltage focus grid system to ground to prevent television receiver damage caused by CRT arc-over. Incorporated within the CRT socket assembly are a high voltage spark gap connected to the CRT's $G_4$ focusing grid and a lower voltage spark gap connected to $G_3$ focusing grids, each spark gap including ridged sections defining an inter-electrode aperture. By varying the size of the inter-electrode aperture and its distance from each electrode, the spark gap's arc-over threshold voltage and breakdown voltage range from initial arc-over to continuous corona discharge may be precisely controlled.

13 Claims, 6 Drawing Figures

CATHODE RAY TUBE SOCKET WITH CONTROLLED SPARK GAPS

BACKGROUND OF THE INVENTION

This invention generally concerns an improved system and method for protecting television receiver circuitry from overvoltage surges caused by cathode ray tube arc-over and more specifically is directed to a cathode ray tube socket incorporating controlled, or tuned, spark gaps for dissipating to neutral ground potential cathode ray tube overvoltage surges which exceed a precisely specified voltage threshold in providing protection for television receiver circuitry.

Occasionally large transient voltages are generated within the cathode ray tube (CRT) of a television receiver. These high voltage surges in the CRT are caused by arc-over between various tube components. CRT arcing is due to voltage discharge from regions of the tube at anode potential to elements of the tube initially at lower potentials. This discharge momentarily increases the potential of these elements to values much higher than that for which they were designed. Not only can the CRT be damaged by arc-over, but damage to circuit elements in the television receiver itself may occur if the high potential appears at the connector pins of the CRT. Unless these voltages are controlled or dissipated, they may be conducted through the tube pins and CRT socket contacts to other portions of the circuitry associated with the tube. Even if such arc-over causes no CRT or television receiver damage, the arc generally produces a loud noise and disrupts the video presentation to the annoyance of the viewer.

It is generally known in the art that most CRT arc-over is caused by loose particles in the electron gun and in the tube neck. These impurities can originate inside the tube as residue from the faceplate screen or internal coating such as dag, or from outside the tube from assembly line contaminants or weld splashes. The occurrence of arcing results in the removal of the accelerating force from the cathode ray beam producing zero brightness on the display device during the arc event. This eliminates the dynamic load on the high voltage power supply which rises to a very high value resulting in CRT arc cascading. This excessively high voltage transient energy overstresses the CRT, high voltage components, and wiring resulting in potential damage to the CRT and associated television receiver circuitry.

One of the primary modes of CRT high voltage performance degradation caused by arc-over involves the $G_3$ and $G_4$ electron beam focus grids of the CRT. Conducting particles on the $G_3$ focus grid, because of the distorted high electric field it produces, emit electrons by field emission. These electrons are accelerated toward the higher potential $G_4$ grid upon which they impinge resulting in leakage current. Those accelerated electrons which miss the $G_4$ focus grid impinge on the grid support rods or tube neck and charge up the surface of impact by causing the emission of secondary electrons. When the potential of the charged surface reaches a sufficiently high value, the charge arcs to regions of lower potential initiating CRT arc-over. In addition, the charging of the neck of the CRT produces an electrostatic field of sufficient magnitude to affect the path of accelerated electrons through the inter-grid space. This produces a shift in the convergence of the picture from the position it would have without stray electron emission and CRT neck charging. If arcing now occurs and the source of stray electron emission changes, the electrostatic potential of the charged CRT neck will change resulting in a shift in video presentation convergence. Thus it can be seen that arc-over involving certain terminal pins, particularly those terminal pins associated with the focus elements of the CRT, require extremely accurate control of the breakdown, or arc-over, voltage to insure proper picture tube performance. The spark gap associated with such terminal contacts must minimize extraneous circuit loading so that the arcing event can be closely and precisely controlled.

Various attempts have been made in the prior art to carefully control the arc-over event in the CRT environment. In general, these attempts have involved the incorporation of individual spark gaps in the CRT socket. These spark gaps are designed to breakdown at a particular potential level and to thereby conduct high voltage transients in the CRT to ground potential level. Basically, the spark gap's discharge voltage increases as the distance between spark gap electrodes increases, and decreases as the inter-electrode distance decreases. By accurately regulating the inter-electrode distance, the prior art has been able to, with varying success, utilize spark gaps having reasonably predictable breakdown voltage characteristics. However, since a change of only approximately 0.001 inch results in a change of about 100 volts in discharge voltage, and since, using generally available production practices, it is difficult to more accurately position spark gap electrodes, the prior art has suffered from performance limitations in attempting to control and regulate CRT arc-over.

One approach to incorporating a high voltage spark gap in a CRT socket is disclosed in U.S. Pat. No. 3,869,633. The invention described therein involves the shearing of elongated radial members across their width to form a gap or opening. As the radial members are sheared, the lower edge of the inner, central portion of the gap assembly is bent downward relative to the adjacent outer portion such that the edge is positioned contiguous to or adjacent to the lower edge of the inner portion. An angled surface is formed during this operation which permits dissipation of arc energy preventing the point of arc ignition from overheating and oxidizing and thereby forming a higher resistance barrier across the gap which affects the ignition, or arc-over, voltage required to establish the next arcing event. In addition, the fabrication of this spark gap configuration is amenable to various abrading processes by which erratic surface protrusions effecting precise control of the arc-over initiating voltage and forming a point of lower impedance to facilitate undesirable corona formation may be easily eliminated. While this approach is capable of precisely controlling electrode surfaces in regulating voltage breakdown of the spark gap, it fails to take into account other more important spark gap characteristics such as the length and configuration of the inter-electrode space.

Another approach to providing arc-over protection in a CRT socket is disclosed in U.S. Pat. No. 3,636,412. Described and claimed therein is a method of forming uniformly controlled spark gaps in which an elliptical barrier wall forming an integral part of the central mounting plate of the socket surrounds a ground ring extension and a high voltage terminal contact extension. The relative position of spark gap electrodes is maintained by a pair of bosses, or studs, which are affixed to the socket's cover plate and positioned in the spark gap during socket fabrication. While this approach provides a simple and easily manufactured socket assembly, it is not intended, nor is it capable of, providing accurate spark gap breakdown voltage control for protecting television receiver components and improving picture tube performance.

Still another approach to over voltage protection in a CRT socket involving the use of spark gaps is disclosed in U.S. Pat. No. 3,716,819 involving the rigid positioning of a first conductive member relative to a second conductive member by encapsulating the conductive members in a plastic material. The rigid incorporation of the conducting members in the encapsulating material to form a plurality of spark gaps ensures uniform conductive member spacing and thus provides a means for maintaining the spark gap breakdown voltage at a precise, predetermined value. This system, however, is limited to handling only the lower voltage components of the CRT. In addition, breakdown voltage regulation is provided by accurate electrode spacing without taking advantage of the inherent operating characteristics of the spark gap cavity. The close electrode spacing and simplified design of this spark gap arrangement result in a limited capability to accommodate the high voltage focusing grid system of the CRT.

The present invention, however, takes into account not only precise spark gap electrode displacement but also the design of the spark gap cavity itself in precisely regulating and controlling the breakdown, or arc-over, voltage of high voltage spark gaps in a CRT socket.

OBJECTS OF THE INVENTION

Accordingly, it is an object of the present invention to provide an improved process and system for electrically coupling a cathode ray tube to a television receiver.

Another object of the present invention is to provide an improved cathode ray tube socket incorporating tuned spark gaps coupled to high voltage focusing grids for precisely controlling voltage surges to the television receiver caused by CRT arc-over. to protect television receiver circuitry from cathode ray tube arc-over by incorporating in the CRT socket a plurality of spark gaps, the arc-over threshold and breakdown voltage range of which can be precisely predicted and regulated.

A further object of the present invention is to provide an inexpensive, easily fabricated cathode ray tube socket which incorporates a safe means for grounding CRT arc-over which exceeds a precisely defined threshold voltage level thus protecting television receiver circuitry from high voltage surges.

Still another object of the present invention is to incorporate in the cathode ray tube socket of a television receiver a plurality of high voltage spark gaps coupled to neutral ground potential for precisely controlling the breakdown voltage and triggering voltage range of the spark gap thus providing cathode ray tube and television receiver circuitry protection from high voltage transients in the cathode ray tube.

BRIEF DESCRIPTION OF THE DRAWINGS

The appended claims set forth those novel features believed characteristic of the invention. However, the invention itself, as well as further objects and advantages thereof, will best be understood by reference to the following detailed description of a preferred embodiment taken in conjunction with the accompanying drawings, where like reference numerals identify like elements, in which:

DESCRIPTION OF THE PREFERRED EMBODIMENT

Figure 1:
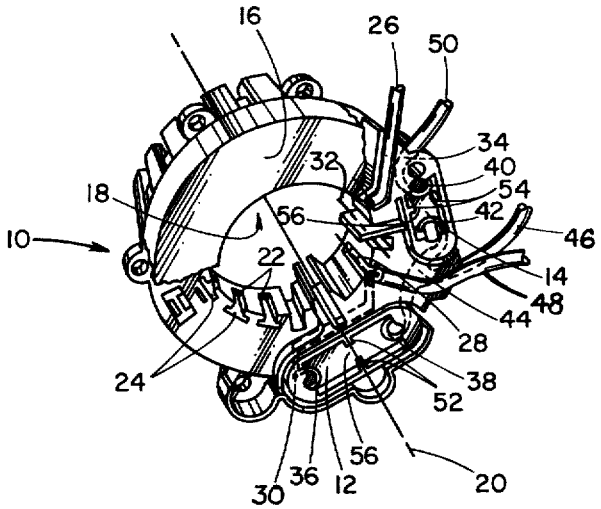
FIG. 1 is a cutaway perspective view of a cathode ray tube socket incorporating precisely controlled spark gaps in accordance with the preferred embodiment of the present invention.

Referring to FIG. 1, there is shown a CRT socket 10 incorporating tuned spark gaps 12 and 14 in accordance with the preferred embodiment of the present invention. Spark gaps 12 and 14 are coupled to the CRT focusing grids (not shown). Spark gap 12, as the high voltage spark gap, is connected to the $G_4$ focusing grid which is operated at approximately 12.7 KV in a typical television receiver CRT. Spark gap 14, as the lower voltage spark gap, is connected to the $G_3$ focusing grids which are operated at approximately 7.9 KV.

The general configuration of CRT socket 12 shown in FIG. 1 is typical of socket arrangements used currently in color television receivers. In general, it includes a dielectric housing which is injection molded from a plastic material such as flame-retardant polypropylene in the shape shown in FIG. 1. The housing includes a cavity 18 oriented transverse to the plane of the general disc shape of the CRT socket. The central hole, or cavity, 18 of the housing 16 is typically keyed in a unique configuration for installation purposes and possesses an axis 20. The dielectric housing 16 also includes on the periphery of the hollow cylindrical cavity 18 a plurality of electrical contacts 22 positioned within and at the bottom of electrical connector guides 24 by means of which electrical contact with pins (not shown) on the base of the CRT is established.

Electrical contacts 22 are coupled to low voltage components of the CRT and to low voltage spark gaps (not shown) which, in turn, are coupled to ground by conductor 26. In this manner low voltage level arc-over protection is provided for television receiver circuitry from low voltage CRT discharges. Another set of electrical contacts (not shown) is located on the bottom of dielectric housing 16 and coupled to electrical contacts 22 via the low voltage spark gaps. These contacts are inserted into the appropriate connector arrangement on a printed circuit board and provide an interface for the CRT with the remainder of the television receiver components.

Protection from high voltage arc-over in the CRT is provided by spark gaps 12 and 14. Since sparks gap breakdown voltage is generally proportional to the inter-electrode spacing, spark gap 12, the larger of the two, is coupled to the high voltage $G_4$ focus grid. Connector pin 28 and conductor 30 couple high voltage spark gap 12 to the $G_4$ focus grid pin (not shown) on the base of the CRT. Connector pin 32 and conductor 34 couple the lower, or intermediate, voltage spark gap 14 to the $G_3$ focus grid connector pin (not shown) also located on the base of the CRT. High voltage spark gap 12 includes an anode 36 and a grounded electrode (cathode) 38. Similarly, intermediate voltage spark gap 14 includes anode 40 and grounded electrode 42. Grounded electrodes 38 and 42 are coupled to each other by conductor 44 which is coupled to grounded conductor 46. High voltage anode 36 is connected to the 12.7 KV high voltage focus control (not shown) by means of conductor 48. Similarly, anode 40 is coupled to the 7.9 KV focus control by means of conductor 50.

Spark gaps 12 and 14 operate to protect television receiver circuitry from high voltage transients in the CRT in the following manner. If an arc-over occurs across one of the CRT focusing grids, a voltage surge is transmitted back to the CRT socket 10 through either connector pin 28 or connector pin 32. An arc-over on the $G_4$ focusing grid will be transmitted back to anode 36 via connector pin 28 and conductor 30. An arc-over on any of the $G_3$ focus grids will be transmitted back to anode 40 via connector pin 32 and spark gap conductor 34. With an overvoltage applied to anode 36, spark gap 12 will break down when its voltage rating is exceeded resulting in the voltage surge being conducted to ground via electrode 38, conductor 44 and grounded conductor 46. An overvoltage surge will similarly be transmitted to ground by the breakdown of spark gap 14 if an overvoltage transient of sufficient voltage level is transmitted back to anode 40.

As thus far described, the structure and operation of the CRT socket set forth in FIG. 1 is entirely conventional and will be readily understood by those skilled in the art and, consequently, additional description thereof is deemed unnecessary. Accordingly, attention may now be drawn to that portion of the CRT socket 10 forming an embodiment of the present invention.

One approach to varying the breakdown voltage of spark gaps 12 and 14 is by varying the inter-electrode spacing to provide the proper overvoltage protection. The present invention, however, makes use of ridges, or ribbed sections, 52 and 54 on the spark gap cavity walls to define an inter-electrode aperture 56 in spark gaps 12 and 14, respectively. Spark gap ridges, or barriers, 52 and 54 not only permit accurate control of spark gap voltage discharge path but also act to concentrate ionization in the inter-electrode aperture 56. By varying the location of the inter-electrode aperture 56 defined by the spark gap ridges the voltage breakdown characteristics of the spark gap may be more precisely controlled.

Figure 2A:
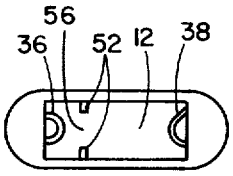
FIGS. 2A through 2C are cross-sectional views of several embodiments of a controlled spark gap in accordance with the present invention.
Figure 2B:
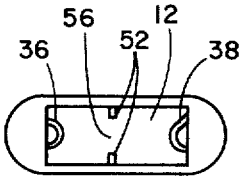
Figure 2C:
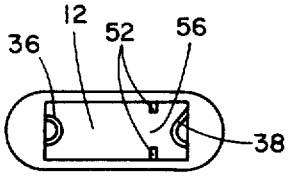

The performance of the spark gap by varying inter-electrode aperture spacing is described with reference to FIGS. 2A through 2C. The spark gap utilized in the preferred embodiment of the present invention is approximately 0.75 inch in length and 0.25 inch in width. Intermediate spark gap voltage breakdown can be achieved by positioning the inter-electrode aperture 56 midway between spark gap electrodes 36 and 38 as shown in FIG. 2B. By moving the inter-electrode aperture 56 toward grounded electrode 38, as shown in FIG. 2C, enhanced spark gap breakdown voltage is realized. For example, with the inter-electrode aperture 56 placed as shown in FIG. 2B, high voltage corona occurs at 18.5 KV. By moving the inter-electrode aperture 56 to within 0.0625 inch of grounded electrode 38, as shown in FIG. 2C, the spark gap's breakdown voltage is increased to 19 KV. Similarly, by moving the inter-electrode aperture 56 to within 0.125 inch of anode 36, as shown in FIG. 2A, the breakdown potential of spark gap 12 is reduced to 15.75 KV. With this linear relationship between spark gap breakdown voltage and inter-electrode aperture placement, the breakdown voltage of the spark gap may be precisely predicted and controlled.

Figure 3A:
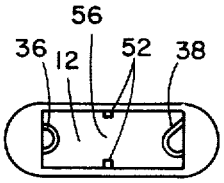
FIGS. 3A and 3B show additional embodiments of the precisely controlled spark gap for incorporation in a CRT socket in accordance with the present invention.
Figure 3B:
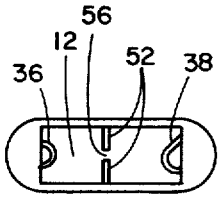

The present invention makes use not only of inter-electrode aperture spacing to control spark gap threshold breakdown voltage, but also permits the voltage range from initial, isolated discharge to final continuous corona discharge to be accurately controlled. Referring to FIGS. 3A and 3B, by decreasing the size of inter-electrode aperture 56 the voltage range from initial arcing to continuous corona may be increased. Similarly, the larger the inter-electrode aperture 56, the larger the voltage variation from initial arc-over to continuous corona discharge for a given spark gap. A linear relationship exists between spark gap breakdown voltage range and inter-electrode aperture size with breakdown voltage range increasing linearly as aperture size increases. Incorporation in spark gap 12 of an inter-electrode aperture 56 0.125 inch in diameter positioned 0.125 inch from anode 36 results in a voltage variation from initial discharge ticking to continuous arcing of 14.5 KV to 16 KV. An inter-electrode aperture 0.0625 inch in diameter similarly positioned results in a reduction in spark gap voltage breakdown range of 14.5 KV to 15.75 KV. Similarly a 0.125 inch diameter inter-electrode aperture positioned 0.0625 inch from grounded electrode 38 produces a voltage range of 16 KV to 17.5 KV from initial arcing to continuous discharge. Reducing the diameter of the aperture to 0.0625 inch results in a reduction in the overall voltage range to 18 KV to 19 KV. By thus varying the size of the inter-electrode aperture, the breakdown voltage range of a spark gap may be either decreased or increased depending upon the environment and application in which the spark gap is employed. For example, a system in which a spark gap is used to control a high voltage source in a feedback control loop in which the spark gap has a narrow voltage breakdown range would require more sophisticated feedback control than a system in which the spark gap displayed a large voltage breakdown range. Table 1 is included to show the performance to the present invention for variously configured spark gap cavities.

TABLE 1

| Inter-Electrode Aperture Diameter (IN.) | Inter-Electrode Aperture Position In Spark Gap (IN.) | Breakdown Voltage For Continuous Corona Discharge (KV) | Breakdown Voltage Range From Isolated Spark-Over To Continuous Corona Discharge (KV.) |
|---|---|---|---|
| 1/16" | ⅛" From Anode | 15.75 | 1.25 (14.5–15.75) |
| | Midway Between Anode and Cathode | 18.5 | 2.0 (16.5–18.5) |
| | 1/16" From Cathode | 19.0 | 1.0 (18.0–19.0) |
| ⅛" | ⅛" From Anode | 16.0 | 1.5 (14.5–16.0) |
| | Midway Between Anode and Cathode | 17.0 | 2.0 (15.0–17.0) |
| | 1/16" From Cathode | 17.5 | 1.5 (16.0–17.5) |

There has thus been shown a spark gap system and a method for precisely controlling spark gap breakdown voltage characteristics. By positioning an inter-electrode aperture closer to the low voltage electrode of the spark gap, the spark gap's breakdown voltage may be significantly increased while placing the inter-electrode aperture in the vicinity of the high voltage electrode results in a reduction in the breakdown voltage of the spark gap. Similarly, it has been shown that decreasing the size of the inter-electrode aperture results in the reduction in the voltage range from initial spark gap breakdown to continuous corona discharge for a given spark gap while increasing aperture size increases spark gap voltage breakdown range.

Changes in construction will occur to those skilled in the art and various apparently different modifications and embodiments may be made without departing from the scope of the invention. The matter set forth in the foregoing description and accompanying drawings is offered by way of illustration only and not as a limitation. The actual scope of the invention is intended to be defined in the following claims when viewed in their proper perspective against the prior art.

We claim:

1. In a cathode ray tube socket for mechanically and electrically coupling a cathode ray tube to a television receiver including a plurality of first electrical connecting means for receiving a first set of conductors coupled to high voltage elements in a cathode ray tube, a plurality of second electrical connecting means for receiving a second set of conductors coupled to a plurality of high voltage sources in said television receiver, a dielectric housing having a central opening disposed therein with said first electrical connecting means disposed on the periphery of said central opening and said second electrical connecting means disposed on the outer periphery of said dielectric housing, a controlled spark gap for dissipating to neutral ground potential transient voltage surges originating in said cathode ray tube and exceeding a precisely determined voltage level, said spark gap comprising:

means defining a cavity within said dielectric housing;

first electrode means disposed within said cavity, said first electrode means coupled to said first and second electrical connecting means;

second electrode means disposed within said cavity, said second electrode means coupled to neutral ground potential; and wall means extending into said cavity and defining an aperture between said first and second electrodes, said wall means having a predetermined position between said electrodes corresponding to a predetermined breakdown voltage of said spark gap, said position being selected from a range of positions which corresponds to a range of spark gap breakdown voltages which includes said predetermined breakdown voltage, said range of breakdown voltages being such that the low end is associated with positions of said aperture nearest said first electrode.

2. A spark gap in a cathode ray tube socket according to claim 1 wherein said inter-electrode aperture defined by said wall means is circular in shape.

3. A spark gap in a cathode ray tube socket according to claim 1 wherein said inter-electrode aperture defined by said wall means is rectangular in shape.

4. A spark gap in a cathode ray tube socket according to claim 1 wherein said first set of conductors couples a plurality of electron beam focus grids in said cathode ray tube to said first electrode means disposed within said spark gap.

5. A spark gap in a cathode ray tube socket according to claim 1 wherein a linear relationship exists between the inter-electrode position of said wall means and spark gap breakdown voltage with spark gap breakdown voltage increasing linearly with increasing spacing between said wall means and said first electrode means.

6. In a cathode ray tube socket for mechanically and electrically coupling a cathode ray tube to a television receiver including a plurality of first electrical connecting means for receiving a first set of conductors coupled to high voltage elements in a cathode ray tube, a plurality of second electrical connecting means for receiving a second set of conductors coupled to a plurality of high voltage sources in said television receiver, a dielectric housing having a central opening disposed therein with said first electrical connecting means disposed on the periphery of said central opening and said second electrical connecting means disposed on the outer periphery of said dielectric housing, a controlled spark gap for dissipating to neutral ground potential a precisely determined range of transient voltage surges originating in said cathode ray tube, said voltage range corresponding to isolated arc-over at a predetermined lower voltage level to continuous corona discharge at a predetermined higher voltage level, said spark gap comprising:

means defining a cavity within said dielectric housing;

first electrode means disposed within said cavity, said first electrode means coupled to said first and second electrical connecting means;

second electrode means disposed within said cavity, said second electrode means coupled to neutral ground potential; and wall means extending into said cavity and defining an aperture between said first and second electrodes, said wall means having a predetermined spacing in defining an aperture of predetermined size, said aperture size being selected from a range of sizes which corresponds to a range of spark gap breakdown voltages from isolated arc-over to continuous corona discharge in said spark gap, said range of breakdown voltages being such that a large breakdown voltage range is associated with aperture sizes nearest the large limit of said aperture size range.

7. A spark gap in a cathode ray tube socket according to claim 6 wherein a linear relationship exists between inter-electrode aperture size and spark gap breakdown voltage range from isolated arc-over to continuous corona discharge with spark gap breakdown voltage range increasing linearly with increasing aperture size.

8. In a cathode ray tube socket for mechanically and electrically coupling a cathode ray tube to a television receiver including a plurality of first electrical conducting means for receiving a first set of conductors coupled to high voltage elements in a cathode ray tube, a plurality of second electrical connecting means for receiving a second set of conductors coupled to a plurality of high voltage sources in said television receiver, a dielectric housing having a central opening disposed therein with said first electrical connecting means disposed on the periphery of said central opening and said second electrical connecting means disposed on the outer periphery of said dielectric housing, a controlled spark gap for dissipating to neutral ground potential transient voltage surges originating in said cathode ray tube, said transient voltage surges exceeding a precisely determined voltage level and within a precisely determined voltage range corresponding to isolated arc-over at a predetermined lower voltage level to continuous corona discharge at a predetermined higher voltage level, said spark gap comprising:

means defining a cavity within said dielectric housing, first electrode means disposed within said cavity, said first electrode means coupled to said first and second electrical connecting means;

second electrode means disposed within said cavity, said second electrode means coupled to neutral ground potential; and wall means extending into said cavity and defining an aperture between said first and second electrodes, said wall means having a predetermined spacing in defining an aperture of predetermined size and a predetermined position between said electrodes corresponding to a predetermined breakdown voltage of said spark gap, said aperture size being selected from a range of sizes which corresponds to a range of spark gap breakdown voltages from isolated arc-over to continuous corona discharge in said spark gap, said range of breakdown voltages being such that a large breakdown voltage range is associated with aperture sizes nearest the large limit of said aperture size range and said aperture position being selected from a range of positions which corresponds to a range of spark gap breakdown voltages which includes said predetermined breakdown voltage, said range of breakdown voltages being such that the low end is associated with positions of said aperture nearest said first electrode.

9. A method of forming a high voltage spark gap having a precise breakdown voltage level in a cathode ray tube socket of a television receiver, said television receiver including a high voltage source, for protecting television receiver circuitry from transient overvoltage surges in a cathode ray tube caused by high voltage arc-over between high voltage elements and lower voltage elements in said cathode ray tube when said transient overvoltage surges exceed a predetermined voltage level, which comprises:

providing a cavity within said cathode ray tube socket;

fixedly positioning first and second electrode means in said cavity;

electrically coupling said first electrode means to said high voltage elements in said cathode ray tube and to said high voltage source in said television receiver;

electrically coupling said second electrode means to neutral ground potential; and fixedly positioning rigid wall means in said cavity between said first and second electrodes so as to define an inter-electrode aperture, said wall means having a predetermined position between said electrodes corresponding to a predetermined breakdown voltage of said spark gap, said position being selected from a range of positions which corresponds to a range of spark gap breakdown voltages which includes said predetermined breakdown voltage, said range of breakdown voltages being such that the low end is associated with positions of said aperture nearest said first electrode.

10. The method of claim 9 wherein said inter-electrode aperture defined by said wall means is circular in shape.

11. The method of claim 9 wherein said inter-electrode aperture defined by said wall means is rectangular in shape.

12. A method for precisely establishing the breakdown voltage range from initial, isolated spark-over to continuous corona discharge in a spark gap in a cathode ray tube socket of a television receiver, said television receiver including a high voltage source, for protecting television receiver circuitry from transient overvoltage surges in a cathode ray tube caused by high voltage arc-over between high voltage elements and lower voltage elements in said cathode ray tube when said transient over voltage surges are within said breakdown voltage range, which comprises:

providing a cavity within said cathode ray tube socket;

fixedly positioning first and second electrode means in said cavity;

electrically coupling said first electrode means to said high voltage elements in said cathode ray tube and to said high voltage source in said television receiver;

electrically coupling said second electrode means to neutral ground potential; and fixedly positioning rigid wall means in said cavity between said first and second electrodes so as to define an inter-electrode aperture, said wall means having a predetermined spacing in defining an aperture of predetermined size, said aperture size being selected from a range of sizes which corresponds to a range of spark gap breakdown voltages from isolated arc-over to continuous corona discharge in said spark gap, said range of breakdown voltages being such that a large breakdown voltage range is associated with aperture sizes nearest the large limit of said aperture size range.

13. a method of forming a high voltage spark gap having a precise, continuous corona breakdown voltage level and breakdown voltage range from initial, isolated spark-over to continuous corona discharge in a cathode ray tube socket of a television receiver, said television receiver including a high voltage source, for protecting television receiver circuitry from transient overvoltage surges in a cathode ray tube caused by high voltage arc-over between high voltage elements and lower voltage elements in said cathode ray tube when said transient overvoltage surges are within said breakdown voltage range and exceed a predetermined voltage level, which comprises:

providing a cavity within said cathode ray tube socket;

fixedly positioning first and second electrode means in said cavity;

electrically coupling said first electrode means to said high voltage elements in said cathode ray tube and to said high voltage source in said television receiver;

electrically coupling said second electrode means to neutral ground potential; and fixedly positioning rigid wall means in said cavity between said first and second electrodes so as to define an inter-electrode aperture, said wall means having a predetermined spacing in defining an aperture of predetermined size and a predetermined position between said electrodes corresponding to a predetermined breakdown voltage of said spark gap, said aperture size being selected from a range of sizes which corresponds to a range of spark gap breakdown voltages from isolated arc-over to continuous corona discharge in said spark gap, said range of breakdown voltages being such that a large breakdown voltage range is associated with aperture sizes nearest the large limit of said aperture size range and said aperture position being selected from a range of positions which corresponds to a range of spark gap breakdown voltages which includes said predetermined breakdown voltage, said range of breakdown voltages being such that the low end is associated with positions of said aperture nearest said first electrode.

* * * * *